United States Patent [19]

Schickel

[11] Patent Number: 4,496,457

[45] Date of Patent: Jan. 29, 1985

[54] ROTOR-TYPE MAGNETIC PARTICLE SEPARATOR

[75] Inventor: Alfred Schickel, Freiberg, German Democratic Rep.

[73] Assignee: Veb Schwermaschinenbau-Kombinat "Ernst Thälmann" Magdeburg, Magdeburg, German Democratic Rep.

[21] Appl. No.: 422,848

[22] Filed: Sep. 24, 1982

[30] Foreign Application Priority Data

Sep. 29, 1981 [DD] German Democratic Rep. ... 233668

[51] Int. Cl.[3] ..... B03C 1/14

[52] U.S. Cl. ..... 209/223 R; 209/232; 209/222; 210/222

[58] Field of Search ..... 210/222, 223; 209/214, 209/223.1, 220-222, 224, 232

[56] References Cited

U.S. PATENT DOCUMENTS

| | | | |
|---|---|---|---|
| 1,067,287 | 7/1913 | Ullrich | 209/222 |
| 1,076,213 | 10/1913 | Langguth | 209/224 |
| 3,326,374 | 6/1967 | Jones | 210/222 |
| 3,375,925 | 4/1968 | Carpenter | 209/223.1 |
| 3,830,367 | 8/1974 | Stone | 209/232 |
| 3,902,994 | 9/1975 | Maxwell et al. | 209/232 |
| 3,935,095 | 1/1976 | Susse et al. | 209/222 |
| 4,116,839 | 9/1978 | Unkelbach et al. | 210/222 |
| 4,191,591 | 5/1979 | Bender et al. | 209/232 |
| 4,208,277 | 6/1980 | Lofthouse et al. | 209/232 |

FOREIGN PATENT DOCUMENTS

| | | | |
|---|---|---|---|
| 1132062 | 6/1962 | Fed. Rep. of Germany . | |
| 2016304 | 9/1979 | United Kingdom | 210/222 |
| 852363 | 8/1981 | U.S.S.R. | 209/221 |

OTHER PUBLICATIONS

"Magnetic Intensity Needed to Extract Various Mineral: (High Intensity Wet Magnetic Separator)", SP. 248—Aug. 1976.

Die Aufbereitung Schwach magnetisierbarer Eisenerze durch nasse Starkfeld-Magnetscheidung—by Dr. L. Wenz et al., pp. 142-149.

*Primary Examiner*—Frank W. Lutter
*Assistant Examiner*—Wm. Bond
*Attorney, Agent, or Firm*—Karl F. Ross; Herbert Dubno

[57] ABSTRACT

A magnetic separator has a support defining an upright axis, two stationary pole pieces spaced from and around the axis on the support, and a stationary inner ferromagnetic piece extending between the pole pieces and axially bridging same. This inner piece defines with the outer pieces respective angularly offset separation gaps. Means is provided, normally in the form of coils, for energizing the pole pieces and thereby creating a magnetic field extending radially across the gaps and through the inner piece. An annular rotor centered on the axis extends through the gaps. This rotor is formed of an endless angular succession of groups of nonradially extending and spaced-apart rotor elements. It is rotated about the axis to orbit the groups of rotor elements through the gaps and particulate material including magnetically attractable particles is fed axially down through the rotor as it rotates. Particles are then washed from the elements at a location angularly offset from the gaps. The rotor elements are normally wholly nonmagnetic and the rotor-element groups are separated by radially extending walls.

9 Claims, 3 Drawing Figures

ROTOR-TYPE MAGNETIC PARTICLE SEPARATOR

FIELD OF THE INVENTION

The present invention relates to a magnetic particle separator. More particularly this invention concerns such a separator used to strip magnetic and paramagnetic particles continuously from a particle stream.

BACKGROUND OF THE INVENTION

It is standard practice, as for instance in a so-called Jones strong-field separator, to strip the magnetic particle phase from a stream of a fluid such as water carrying a solid particle phase. Typically the stream is an iron-ore slurry including magnetic and paramagnetic particles such as red hematite, brown hematite (limonite), ilmenite, wolframite, biotite, and siderite, at least some of which, like ilmenite, are of feeble magnetic character. Such a system, as described in German patent publication No. 1,132,062, forms a powerful magnetic field between a stationary outer pole piece and a rotary inner pole piece. The particle-containing stream is passed through the gap between these pieces so that the ferromagnetic and paramagnetic particles cling to at least the inner pole piece. As same turns, however, it moves the particles it picks up out of the magnetic field to an upstream rinsing and separating zone where a water spray cleans off any entrained nonmagnetic particles plus weakly magnetically attractable or paramagnetic particles. Downstream from this upstream location is another washing location where a very high-pressure spray strips the remaining particles from the rotating inner pole piece. Further such systems are described in *Aubereitungstechnik* (1973; 3, pp 142–149) and "Boxmag-Rapid" (No. BR 18, HHC/4000/3/79).

In such a system the remanence of the rotor often causes some of the particles to stick so strongly to it that they cannot readily be removed, even by a very high-pressure spray. In time these particles crust together to a hard layer that makes the system unworkable, so the rotor must be taken out and cleaned or replaced.

Thus it is standard to provide upstream of the strong-field separator, relative to the flow of the particle-containing stream, a weak-field separator which strips out all of the ferromagnetic and even some of the highly paramagnetic particle phase. This can be done with a weaker field which will allow the separated-out particles to be stripped with some ease from the rotor drum. The obvious problem with this solution is that it greatly increases the equipment expense and amount of space the separating equipment occupies.

Another problem with the known machines is that they consume a great deal of energy. In addition to the considerable electrical current needed to form an electromagnetic field powerful enough to pull the desired particles out of the stream, the hysteresis load of the rotor often accounts for up to a third of the electrical-energy consumption of the system. This motor-style operation of the rotor, in which the rotating pole piece closes the magnetic loop, is a complete waste of energy as it does no useful separation work.

OBJECTS OF THE INVENTION

It is therefore an object of the present invention to provide an improved magnetic separator.

Another object is the provision of such a magnetic separator which overcomes the above-given disadvantages.

Yet another object is to provide a rotor-type magnetic separator which does not clog up with particles and which can be operated with minimal electrical energy and with minimal water pressure to wash off the stripped-out particles.

SUMMARY OF THE INVENTION

These objects are attained according to the instant invention in a magnetic separator having a support defining an upright axis, two stationary pole pieces spaced from and around the axis on the support, and a stationary inner magnetically permeable, normally ferromagnetic, piece extending between the pole pieces and axially bridging same. This inner piece defines with the outer pieces respective angularly offset separation gaps. Means is provided, normally in the form of coils, for energizing the pole pieces and thereby creating a magnetic field extending radially across the gaps and through the inner piece. An annular drum-type rotor centered on the axis extends through the gaps. This rotor is formed of an endless angular succession of groups of nonradially extending and spaced-apart rotor elements and is rotated about the axis to orbit the groups of rotor elements through the gaps. Particulate material including magnetically attractable particles is fed axially down through the rotor as it rotates. Particles that are trapped by the rotor as described below are then washed from the elements at a location angularly offset from the gaps.

Thus a liquid or gas stream carrying a mass of particles at least some of which are magnetically attractable is fed axially at at least one of the gaps through the rotor, passing over and between the rotor elements. Assuming that the field at the gap is sufficiently strong and homogenous and that there is a sufficient portion of ferromagnetic and strongly paramagnetic particles in the stream, these particles will polarize and form chains radially bridging the rotor elements and thereby staying with the rotor, while the nonmagnetic and diamagnetic particles pass axially down through the rotor. As the rotor turns and moves these bridges of magnetically attractable particles out of the field, first the ones with less magnetic character, then those with more magnetic character can be easily stripped from the rotor. The rotor elements do not serve to conduct the magnetic lines of force between the poles, so once out of position between them they will not attract the particles.

According to another feature of this invention the rotor elements, and normally in fact all of the rotor, are nonmagnetic so that they will have no remanence and, once out of the field, there will be nothing to hold the polarized bridges of particles in place on it so that the stripped-out par;ticles can easily be stripped completely from the rotor.

The rotor of the instant invention is generally bell-shaped and the succession of elements form its rim. The inner piece is set inside the bell-shaped rotor. Thus this inner piece serves to close most of the gap between the normally diameterally opposite pole pieces.

In order to prevent the above-described bridges of polarized particles from migrating back on the rotor elements toward the gap the rotating rotor is taking them out of, the rotor is provided with nonmagnetic radially extending walls between the groups of rotor elements.

These elements according to this invention are tangentially extending and parallel rods, that is the rods extend perpendicular to an axial plane bisecting the rod group. They may also be tangentially or nonradially extending plates or wires, or even masses of balls or the like. Mainly they must not have a major dimension extending radially, that is parallel to the field, and must be spaced to permit the particle-containing stream to flow axially through the rotor.

The washing means according to this invention has, relative to the normal rotation direction of the rotor, an upstream washer for removing weakly ferromagnetic and paramagnetic particles from the rotor elements and a downstream washer for removing strongly ferromagnetic particles from the elements. The nonmagnetic particle phase is washed off right at the gap.

DESCRIPTION OF THE DRAWING

The above and other features and advantages will become more readily apparent from the following, reference being made to the accompanying drawing in which.

SPECIFIC DESCRIPTION

Figure 1:
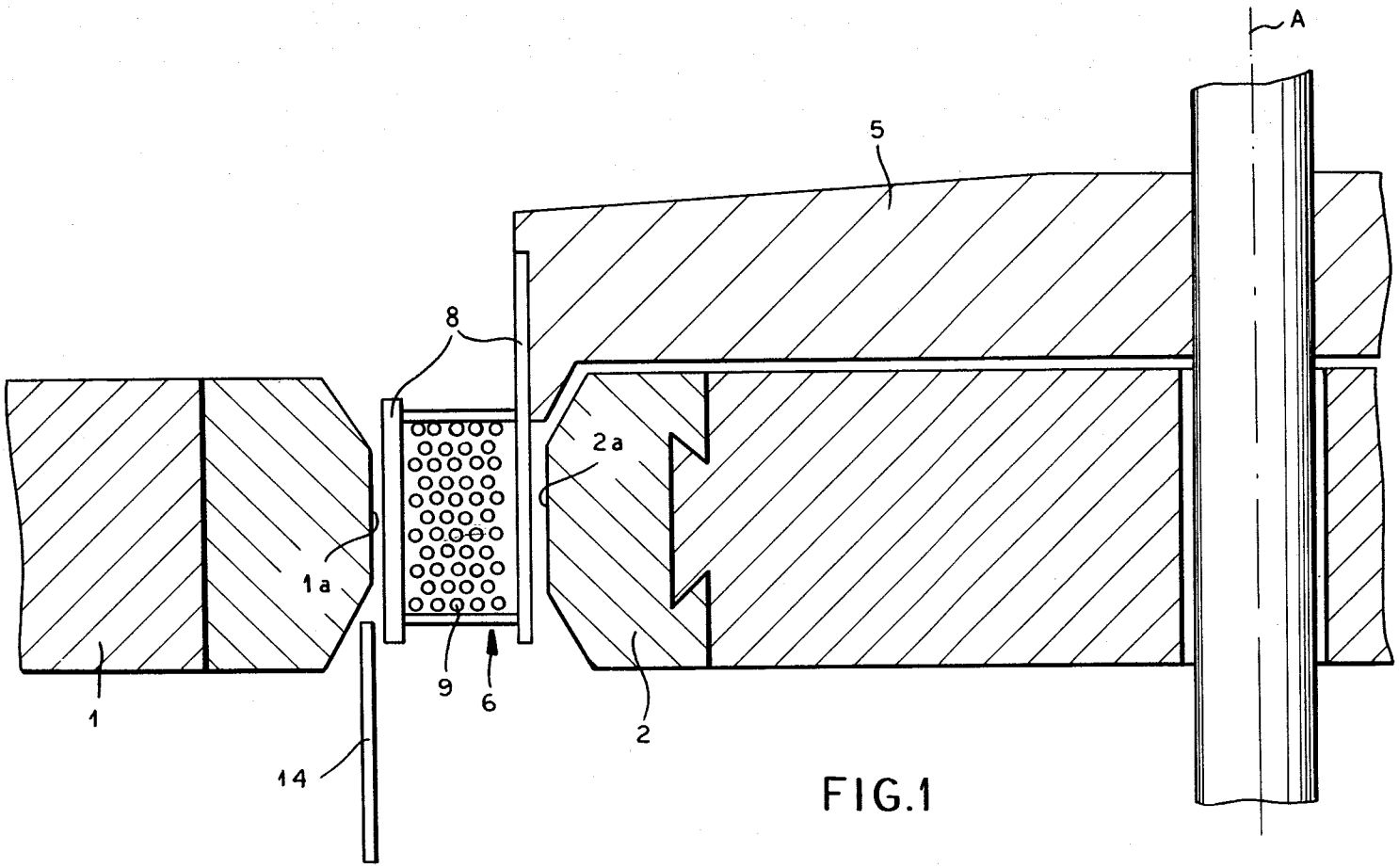
FIG. 1 is a vertical section through a detail of the machine acording to this invention.
Figure 2:
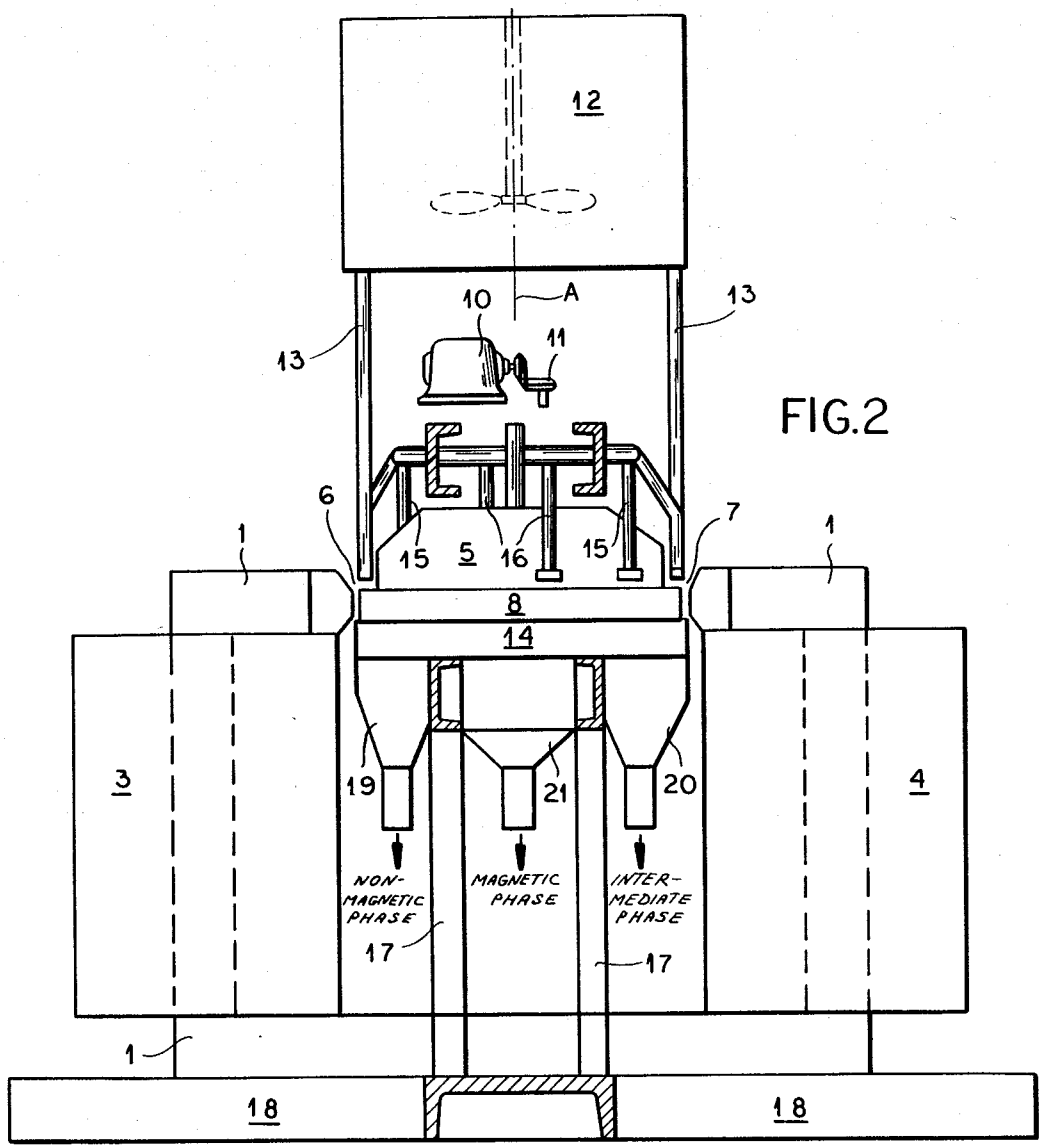
FIG. 2 is a partly sectional end view of the apparatus of the invention.

As seen in FIG. 2, the apparatus according to this invention has a base or support 18 on which stand two large pole pieces 1 provided with respective energization coils 3 and 4. These pieces 1 are ferromagnetic and, as also seen in FIG. 1, have ends 1*a* between which a stationary ferromagnetic piece 2 standing on the support 18 via legs 17 extends diametrally relative to an upright axis A. The piece 2 has ends 2*a* parallel to and confronting the faces 1*a* to form two diametrally opposite gaps 6 and 7. When the coils 3 and 4 are energized they form a homogeneous field that passes in the air radially across these gaps 6 and 7.

Figure 3:
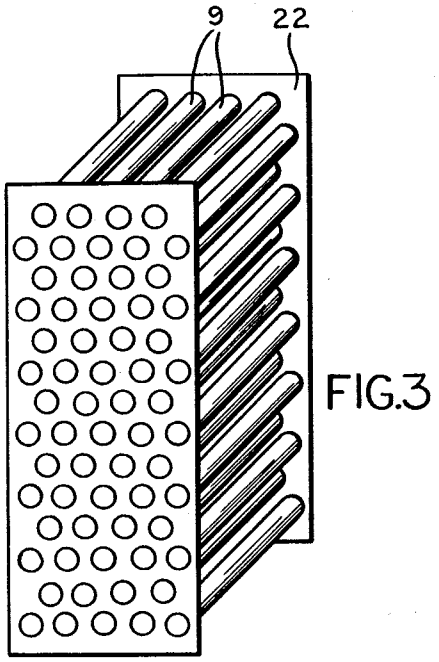
FIG. 3 is a perspective view of a detail of the rotor of the machine according to the invention.

A bell-shaped rotor 5 centered on the axis A is suspended above the pieces 1 and 2 and has an annular rim 8 extending down into the gaps 6 and 7. This rim 8 is formed as seen in FIG. 3 of a plurality of groups of parallel nonmagnetic rods 9 extending tangentially, that is along respective axis perpendicular to a common axial plane, to the axis A between end walls or partitions 22 which extend substantially axially and radially. The rods 9 and walls 22 are wholly nonmagnetic, being made of brass or bronze, and are spaced apart. An electric drive motor 10 is connected via gearing 11 to the rotor 5 to turn it about the axis A.

Above the apparatus a supply 12 of particles mixed with water, although it is possible to use airborne particles, has downwardly extending feed tubes 13 that can pour this slurry down into the gaps 6 and 7. In addition the machine is provided below the gaps 6 and 7 with an annular shield 14 whose cylindrical inner surface is axially aligned with the surfaces 1*a* and whose upper edge is slightly above the lower edge of the rim 8. Washers 15 and 16 associated with particle collectors 20 and 21 are provided around the periphery of the rotor 5 in customary fashion, and a collector 19 is also appropriately positioned to catch the nonmagnetic particle phase.

The apparatus can therefore form a strong and homogeneous magnetic field at the gaps 6 and 7. As the rotor 5 rotates the rod elements 9 will orbit through these gaps and at one time each rod 9 will be wholly within the respective field, but since these elements are nonmagnetic this will consume little energy, generating at most minor eddy currents in the rods 9. Each section of the rotor therefore moves through the field twice with each revolution of the rotor, and of course if more than two pieces 1 were provided more such passages would be made.

Meanwhile the tubes 13 are dumping a slurry containing some portion of magnetically attractable particles into the gaps 6 and 7 from above. These magnetically attractable particles will polarize and form into radially extending chains or bridges extending between adjacent rods 9. The nonmagnetic or only feebly attractable particles will pass down through the rotor rim 8 to be captured in the collector 19.

As the rotor 5 turns to move these chains out of the gap 6 the washers 15 will strip the somewhat magnetically attractable particles from the rotor 5 so they can be captured at 20. With further rotation wholly out of the field the particles are rinsed off completely by the device 16 and captured at 21.

The system of the instant invention can therefore relatively easily separate out strongly paramagnetic particles, without having to first remove the ferromagnetic-particle phase. The polarized-particle chains which secure the magnetic particles in place between the nonmagnetic rods 9 collapse outside the field at the gaps so these particles can be washed from the rods 9 without having to use very high pressure. The particles will simply not crust up on the rotor elements as in the prior-art systems. In addition since there are no hysteresis losses in the nonmagnetic moving parts the apparatus can run with considerably less current consumption than the prior-art separators. The piece 1 closes the magnetic loop except at the gaps 6 and 7, so that a field of adequate strength can be produced with relatively small electrical consumption.

I claim:

1. A magnetic separator comprising:

a support defining an upright axis;

two stationary pole pieces spaced from and around said axis on said support;

a stationary inner ferromagnetic piece extending between said pole pieces and axially bridging same, said inner piece defining with said pole pieces respective angularly off-set gaps;

means for energizing said pole pieces and thereby creating a magnetic field extending radially across said gaps and through said inner piece;

an annular rotor centered on said upright axis and extending through said gaps, said rotor being formed of an endless annular succession of groups of nonradially extending and spaced-apart wholly nonmagnetic rotor elements disposed in an annulus around said inner piece;

means for rotating said rotor about said axis and thereby orbiting said rotor elements through said gaps;

means for feeding particulate material including magnetically attractable particles axially down through said gaps for interception by said elements of said rotor as said rotor rotates to orbit said elements through said gaps; and means for washing said particles from said elements at a location angularly offset from said gaps.

2. The magnetic separator defined in claim 1 wherein said rotor is generally bell-shaped and said succession of elements form its rim, said inner piece being set inside the bell-shaped rotor.

3. The magnetic separator defined in claim 1 wherein said rotor is wholly nonmagnetic.

4. The magnetic separator defined in claim 1 wherein said rotor is provided with nonmagnetic transversely radially extending walls between said groups of rotor elements.

5. The magnetic separator defined in claim 4 wherein said elements are rods extending tangentially to said annular motor.

6. The magnetic separator defined in claim 5 wherein the rods of each group are parallel to one another.

7. The magnetic separator defined in claim 1 wherein the washing means includes, relative to the normal rotation direction of rotation of said rotor, an upstream washer for removing weakly ferromagnetic and paramagnetic particles and a downstream washer for removing strongly ferromagnetic particles from said elements.

8. The magnetic separator defined in claim 1 wherein the pole-energizing means includes coils on said pole pieces.

9. The magnetic separator defined in claim 1 wherein the means for feeding includes an upright feed tube directed at at least one of said gaps.

* * * * *